US009482010B2

(12) United States Patent
Kartler

(10) Patent No.: US 9,482,010 B2
(45) Date of Patent: Nov. 1, 2016

(54) CORNERBEAD/CORNERAIDE APPARATUS AND RELATED METHODS

(71) Applicant: David Kartler, North Las Vegas, NV (US)

(72) Inventor: David Kartler, North Las Vegas, NV (US)

( * ) Notice: Subject to any disclaimer, the term of this patent is extended or adjusted under 35 U.S.C. 154(b) by 0 days.

(21) Appl. No.: 14/216,984

(22) Filed: Mar. 17, 2014

(65) Prior Publication Data

US 2014/0345216 A1 Nov. 27, 2014

Related U.S. Application Data

(60) Provisional application No. 61/798,538, filed on Mar. 15, 2013.

(51) Int. Cl.

| | |
|---|---|
| ***E04F 13/073*** | (2006.01) |
| ***E04F 13/06*** | (2006.01) |
| ***E04F 19/02*** | (2006.01) |
| ***E04F 19/06*** | (2006.01) |

(52) U.S. Cl.

CPC ..... *E04F 13/0733* (2013.01); *E04F 19/022* (2013.01); *E04F 19/064* (2013.01); *E04F 13/073* (2013.01); *E04F 2013/063* (2013.01)

(58) Field of Classification Search

CPC ..... E04F 13/073; E04F 13/06; E04F 13/002; E04F 2013/063; E04F 2013/066; E04F 13/0733; E04F 13/0866; E04F 21/1655; E04F 3/67356

USPC ..... 52/254, 255, 256, 257, 288.1, 287.1

See application file for complete search history.

(56) References Cited

U.S. PATENT DOCUMENTS

| | | | | | |
|---|---|---|---|---|---|
| 851,932 | A | * | 4/1907 | Grossman | A47B 77/022 52/717.06 |
| 1,161,764 | A | * | 11/1915 | Doner | 52/354 |
| 1,167,837 | A | * | 1/1916 | Pride | 52/250 |
| 1,537,758 | A | * | 5/1925 | Fischer | 52/256 |
| 1,881,805 | A | * | 10/1932 | Mathers | E04F 13/06 52/255 |
| 2,012,203 | A | * | 8/1935 | Peterson | 52/255 |
| 2,151,605 | A | * | 3/1939 | Lavering | 52/396.04 |
| 2,174,940 | A | * | 10/1939 | Hutchisson, Jr. | 52/396.05 |
| 2,189,216 | A | * | 2/1940 | Mathias | 52/216 |
| 2,687,558 | A | * | 8/1954 | Dunlap | 52/287.1 |
| 3,047,112 | A | * | 7/1962 | Tvorik et al. | 52/288.1 |
| 3,201,910 | A | * | 8/1965 | Keesee | E04F 19/0436 424/DIG. 2 |
| 3,318,061 | A | * | 5/1967 | Stentz | 52/288.1 |
| 3,398,494 | A | * | 8/1968 | Larson | 52/371 |
| 3,722,166 | A | * | 3/1973 | McNerney | 52/288.1 |
| 4,430,833 | A | * | 2/1984 | Balzer et al. | 52/255 |
| 4,722,153 | A | * | 2/1988 | Hardy | 52/255 |
| 4,763,455 | A | * | 8/1988 | Schneller | 52/255 |
| 5,138,810 | A | | 8/1992 | Kartler | |
| 5,203,640 | A | * | 4/1993 | Pourtau et al. | 403/403 |
| 5,289,663 | A | * | 3/1994 | Schluter | 52/287.1 |
| 5,477,643 | A | * | 12/1995 | Koenig, Jr. | E04F 13/06 52/100 |
| 5,531,051 | A | * | 7/1996 | Chenier et al. | 52/255 |
| 5,544,463 | A | * | 8/1996 | Bergin | E04F 13/06 52/254 |
| 5,625,986 | A | * | 5/1997 | Mansfield et al. | 52/255 |
| 5,752,353 | A | * | 5/1998 | Koenig et al. | 52/255 |
| 6,189,273 | B1 | * | 2/2001 | Larson | 52/255 |

(Continued)

*Primary Examiner* — Phi A

(74) *Attorney, Agent, or Firm* — J. Mark Holland

(57) ABSTRACT

Methods and apparatus are disclosed for cornerbead or corneraide for finishing the junction between two or more walls. Embodiments include at least one generally central web portion with at least a portion thereof extending and/or deformed away from a person viewing that web portion as assembled in the finished assembly.

8 Claims, 10 Drawing Sheets

(56) References Cited

U.S. PATENT DOCUMENTS 6,553,732 B2 * 4/2003 Shaw ..... E04F 19/022 52/287.1
6,591,566 B1 * 7/2003 Rodlin ..... 52/311.1
7,036,282 B1 * 5/2006 Keddell ..... 52/287.1
7,634,883 B1 * 12/2009 Larson ..... E04F 13/06 52/393
7,774,990 B1 * 8/2010 Castellanos ..... E04D 12/008 52/198
7,793,475 B2 * 9/2010 Riggs ..... 52/288.1
8,104,234 B1 * 1/2012 Sawyer ..... 52/96
8,627,622 B2 * 1/2014 Koenig et al. ..... 52/255
2002/0023400 A1 * 2/2002 Smythe, Jr. ..... 52/287.1
2002/0083665 A1 * 7/2002 Razetto ..... 52/288.1
2003/0033770 A1 * 2/2003 Harel ..... 52/287.1
2003/0037495 A1 * 2/2003 Shaw ..... 52/287.1
2003/0089058 A1 * 5/2003 Kunz et al. ..... 52/255
2004/0074175 A1 * 4/2004 Tierney ..... 52/255
2005/0166529 A1 * 8/2005 Rodolofo et al. ..... 52/716.1
2008/0066403 A1 * 3/2008 Koenig ..... E04F 13/06 52/255
2011/0030297 A1 * 2/2011 Robertson ..... 52/255
2012/0174509 A1 * 7/2012 Dhinjan ..... 52/255
2013/0255171 A1 * 10/2013 Rutherford ..... 52/287.1

* cited by examiner

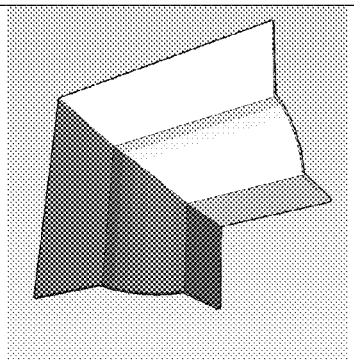
Figure 5A – two pieces mitered into a 90 degree corner
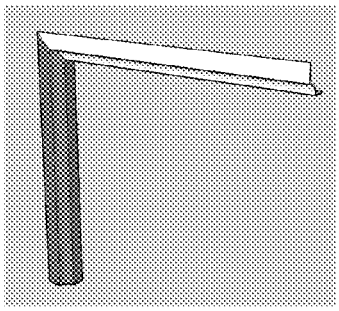
Figure 5B – extended view of the pieces from Fig. 5A
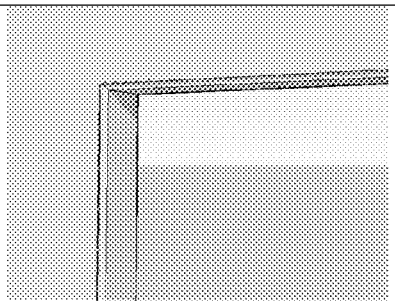
Figure 5C – the pieces of Fig. 5B as they might be used to frame a doorway or window
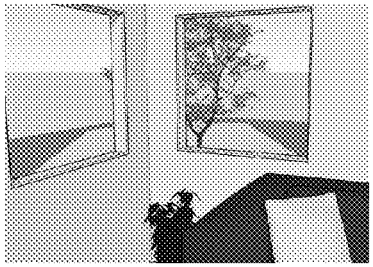
Figure 5D – two windows framed as in Fig. 5C
*FIG. 5.*

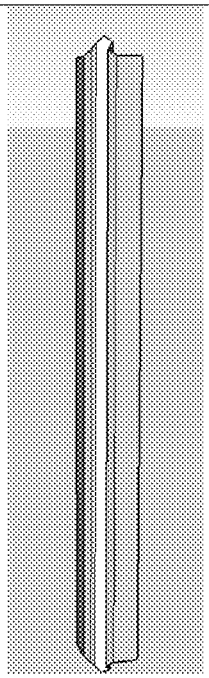

Figure 6.1 –with DOUBLE 45 degree ends

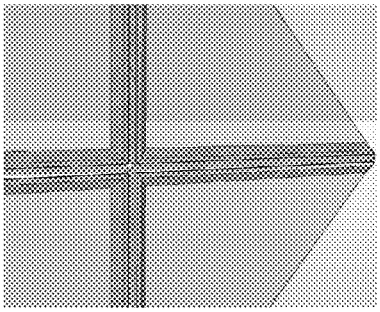

Figure 6.2 – Four pieces cut as shown in Fig. 6.1, then assembled to frame the interior of four adjacent windowpanes (or these and other pieces can be assembled and overlaid onto a single large pane of glass, to provide the effect of French doors)

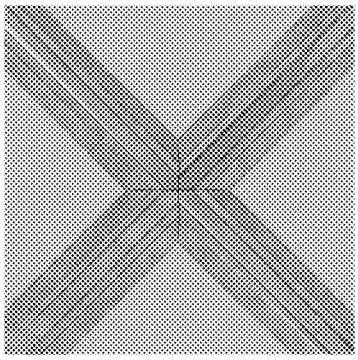

Figure 6.3 - same as Fig. 6.2, but rotated 45 degrees to form diamond pattern

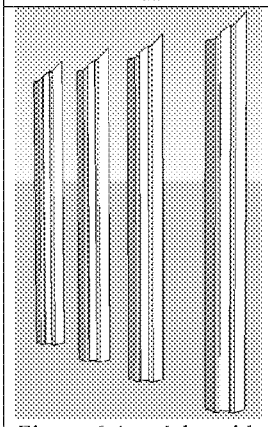

Figure 6.4 –sticks with SINGLE 45 degree angles at one end

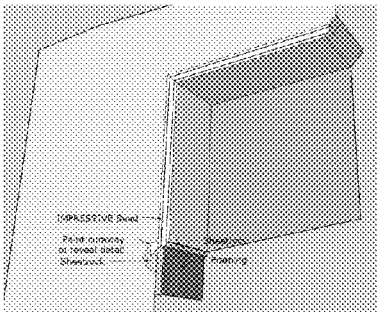

Figure 6.5 –stock as in Fig. 6.4, assembled to frame a window or door

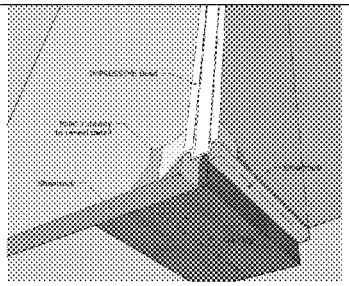

Figure 6.6 – Close up of section detail of Figs. 6.4 and 6.5

*FIGS. 6.1 through 6.6*

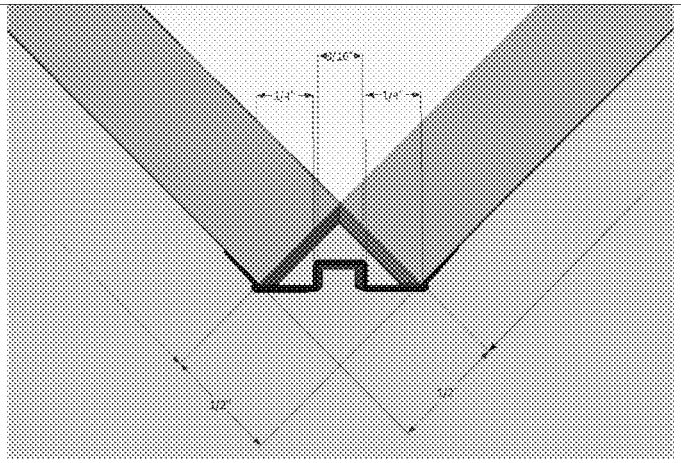
FIG. 7.1 Cross-Section 1 - 1/2 inch sheetrock- the channel is centered, and is approximately 1/8" deep and 3/16" wide
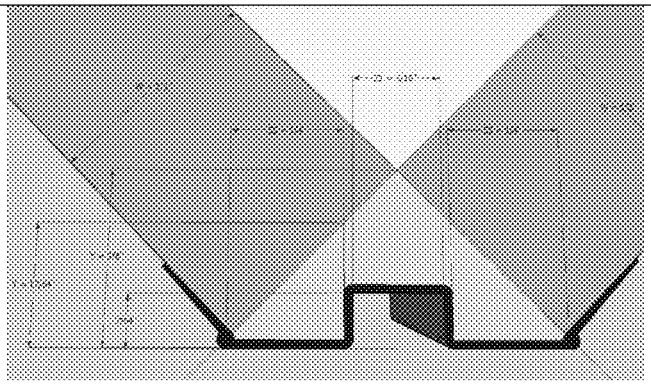
FIG. 7.2 Cross-Section 2 – Variables for dimensions from Cross Section 1 - the channel is centered, and is approximately 1/8" deep and 3/16" wide

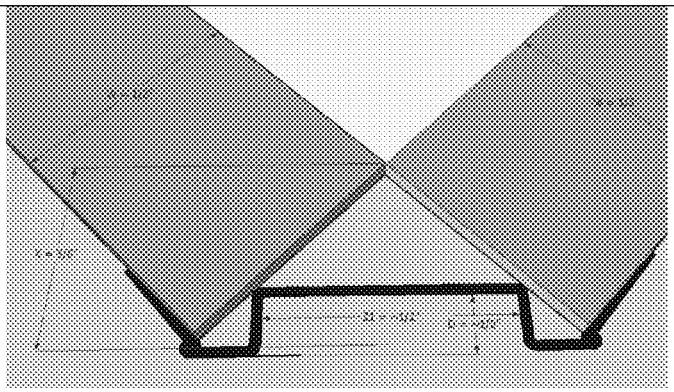

FIG. 7.3 Cross-Section 3 – Same channel DEPTH as Cross Section 7.1 – shows just one of the channel dimensions/combinations, as they can vary across a range of width and depth combinations without changing the wallboard or support structures. Among other things, this shows that you can keep the channel depth approximately the same as in Figures 7.2 and 7.3 (1/8"), but change the channel width up to approximately ½".

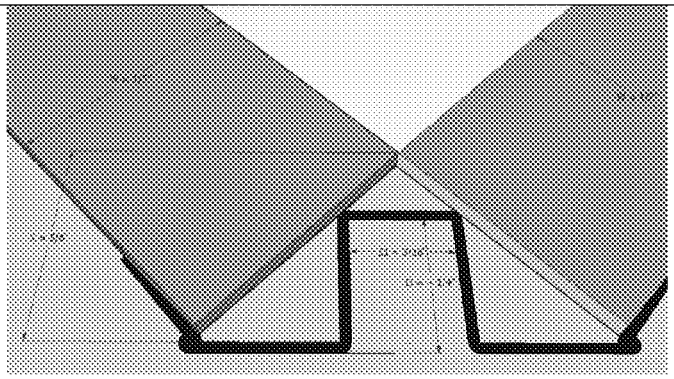

FIG. 7.4 Cross-Section 4 – Same channel WIDTH as Cross Section 7.1 – shows just one of the many other channel dimensions/combinations, as they can vary across a range of width and depth combinations without changing the wallboard or support structures. Among other things, this shows that you can keep the channel width approximately the same as in Figures 7.2 and 7.3 (1/8"), the channel depth can be doubled (up to approximately ¼").

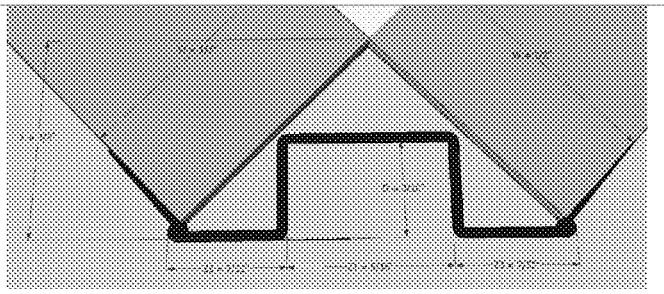

FIG. 7.5 Cross-Section 5 – Same wallboard/framing as Cross Section 7.1 – shows just one of the many other channel dimensions/combinations, as they can vary across a range of width and depth combinations without changing the wallboard or support structures. Among other things, this shows the channel width at 5/16", and the channel depth at 3/16".

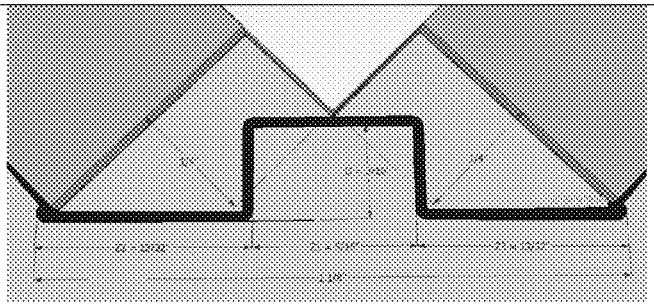

Figure 7.6 – Holding wallboard ¼" further back from corner, with same channel dimensions as Figure 7.5. This illustrates channels that are 3/16" X 5/16"

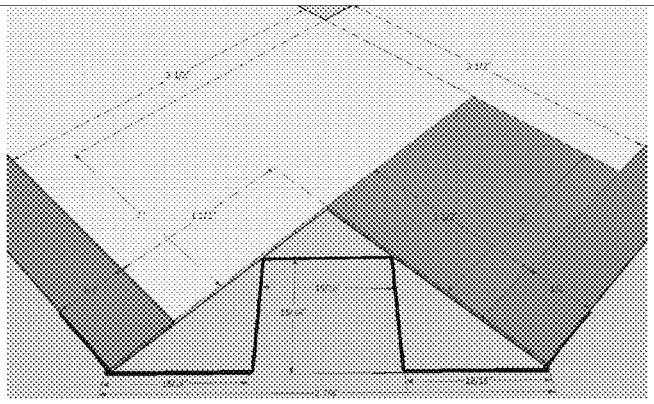

Figure 7.7 – Holding wallboard AND framing back from corner (compare to Figure O above); Corner 2X4 is held back (to the left) 1 ½ inches (or whatever distance desired, subject to structural limitations); optional extra framing piece is shown in orange as a 2X2 (1 ½ X 1 ½ cross section). This illustrates channels that are 15/16" X 15/16",

CORNERBEAD/CORNERAIDE APPARATUS AND RELATED METHODS

This application is based on and claims priority to U.S. provisional application Ser. No. 61/798,538, filed Mar. 15, 2013.

This invention relates broadly to cornerbead/corneraide products and related tools and methods for finishing corners of sheetrock/drywall (or other materials) on walls, to enable builders and owners to create distinctive, comfortable, and beautiful rooms and buildings. As indicated herein, the inventions disclosed herein can be used in a broad range of applications and provide many benefits.

Although many other applications exist for the invention, some examples include in connection with or "as" chair rail, crown moulding, window/doorway trim, and exterior applications. Any of the many configurations of the "central web" or "face" portion of the cornerbead of the invention can be used with varying attachment/connections wing profiles, as may be appropriate and/or useful for each application.

Although products embodying and/or incorporating the invention can be fabricated from any suitable material and by any suitable method, convenient approaches include conventional vinyl/extrusion and/or metal/roll-form processes.

These and other embodiments will become readily apparent to those skilled in the art from the following detailed description of embodiments having reference to the attached figures, the invention not being limited to any particular preferred embodiment(s) disclosed.

BRIEF DESCRIPTION OF THE DRAWINGS

FIGS. 5A-5D illustrates some examples including in connection with (or "as") chair rail, crown moulding, window/doorway trim, and exterior applications.

FIGS. 6.1 through 6.6 illustrate adapted into crown moulding and similar trim pieces. For certain applications (for example, inside corners, such as on a windowsill), it may be useful to provide a 45 degree angle on one or both ends. FIG. 6.1 shows such a piece, and FIGS. 6.2 and 6.3 shows how two such pieces might be assembled together.

FIGS. 7.1 through 7.7 illustrate how, among the many alternative applications of the invention, the sheetrock can be different thicknesses, and/or the sheetrock or even the support framing can be "held back" further from the corner. By doing so, larger sizes of channels or other shapes can be utilized at the joint. Examples of such approaches are shown below in FIGS. 7.6 and 7.7 (with respectively).

DETAILED DESCRIPTION OF EMBODIMENTS

Figure 1:
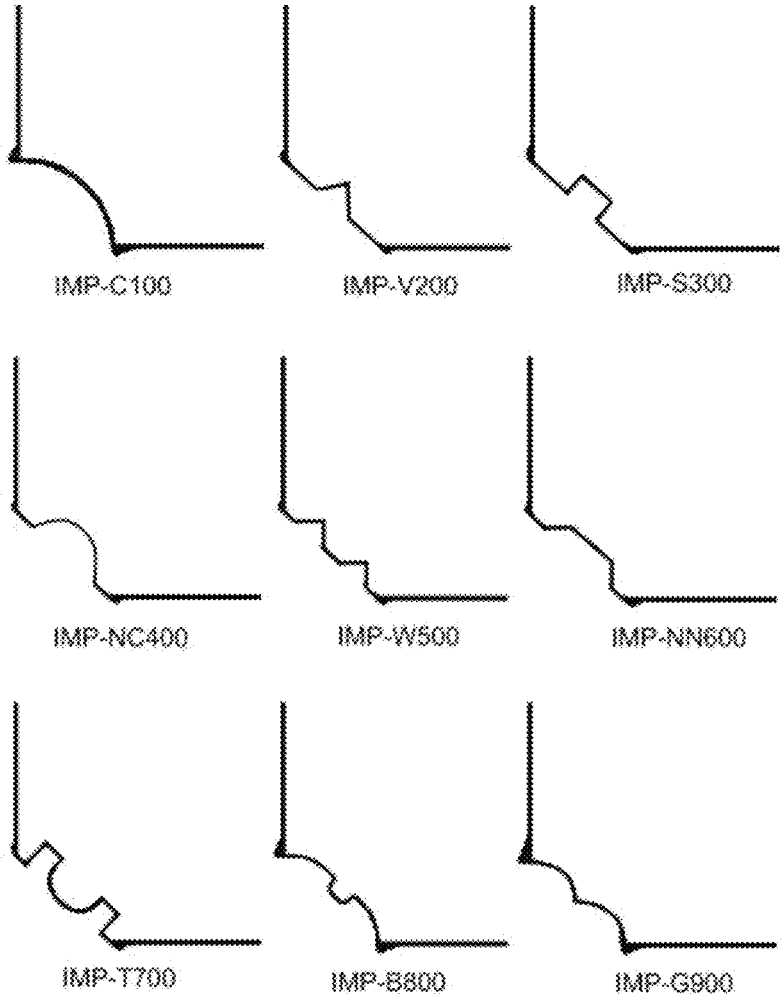
FIG. 1 illustrates some of the cornerbead designs that incorporate the invention, shown in cross section.
Figure 2A:
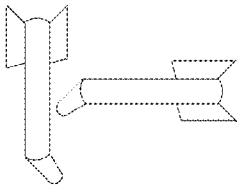
FIGS. 2A-2B illustrates some of the related tools of the invention, for finishing, floating, and cleaning wallboard joints.
Figure 2B:
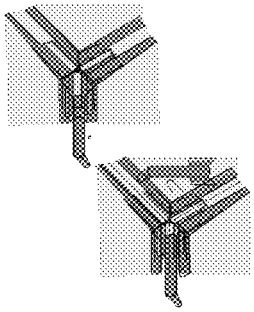

As indicated above, the inventions disclosed herein can be used in a broad range of applications and provide many benefits. Embodiments of the present invention will now be described with references to the accompanying figures, wherein like reference numerals refer to like elements throughout.

Persons of ordinary skill in the art will understand that the apparatus of the invention and variations of its many methods can be practiced using any of a wide variety of suitable processes and materials.

Certain of the drawings illustrate how the underlying material (wallboard, sheetrock, etc.) may be held back slightly from the relevant edge of the corner assembly, to make use of various embodiments of the invention even more conveniently. Depending on the particular size of the embodiment, any such "holdback" distance may vary, or may not be needed. If needed, the sheetrock at the corners can easily be cut back to allow selection and use from a wide range of embodiments. Some of the drawings show a series of exemplary section views to illustrate how supporting materials (framing, wallboard, sheetrock, etc.) may be positioned to provide even further options in the use of the invention. The size of the desired finishing product embodiment can affect the need for and/or amount of "holdback": relatively smaller profiles may require no "special" holdback from the corner (of those supporting materials); larger profiles may require some degree of setback.

In addition to use in new construction, the inventions can be used for remodeling projects. For remodeling projects, existing sheetrock at the corners typically easily can be cut back (to achieve any needed "holdback"), and the framing at the corner can be trimmed back to accommodate larger sizes.

Persons of ordinary skill in the art will understand that, in addition to walls that reach from a room's floor to ceiling, the invention can be used on half-walls and other "partial" structures. Room dividers and similar structures, for example, may use a "three-way" version of the invention to help join wallboard or other material that is disposed on three or more different planes.

Some of the many benefits, objects, and advantages of the inventions include the following, which may or may not be present in any given embodiment of the inventions:

1. In many applications, the cornerbead will fit more snugly and straighter than prior art devices.
2. In many applications, the cornerbead will not roll or twist along its lengthwise axis, at least not to the degree that can occur with prior art devices.
3. In many applications, applying the taping mud (wallboard compound, etc.) is effectively like applying one side (one wall) at a time, rather than having to simultaneously finish "both" sides. For example, and in contrast to finishing conventional square corner bead, the mud preferably will not flip over onto the "other" wall/side (which messes up that "other" side, especially if that "other" side has itself just been finished and is not yet dry). This makes it easier to keep the bead and the corner clean and neat, and can therefore expedite the process and reduce waste of materials and time.

Figure 3A:
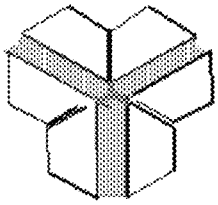
FIGS. 3A-3C illustrates some of the corner cap elements of the invention, for easy and beautiful finishes of exposed corners.
Figure 3B:
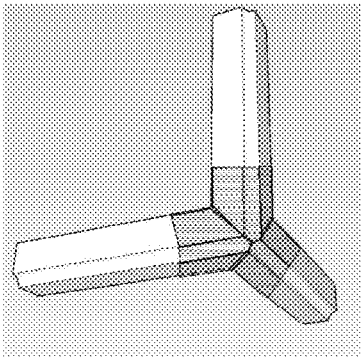
Figure 3C:
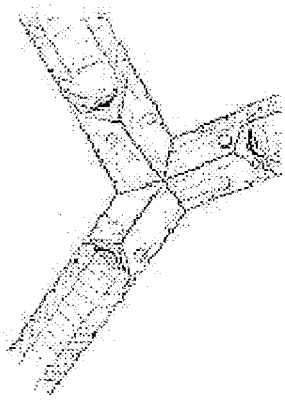
Figure 4:
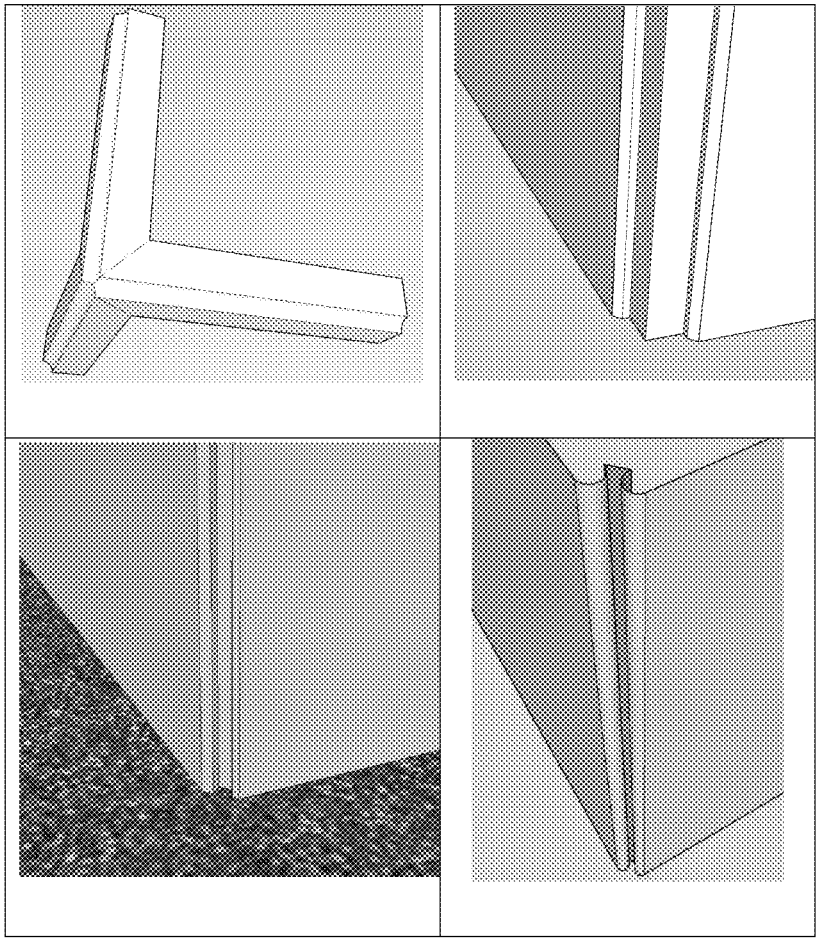
FIG. 4 illustrates samples of the many ways various embodiments of the invention can be installed and enjoyed.
Figure 8:
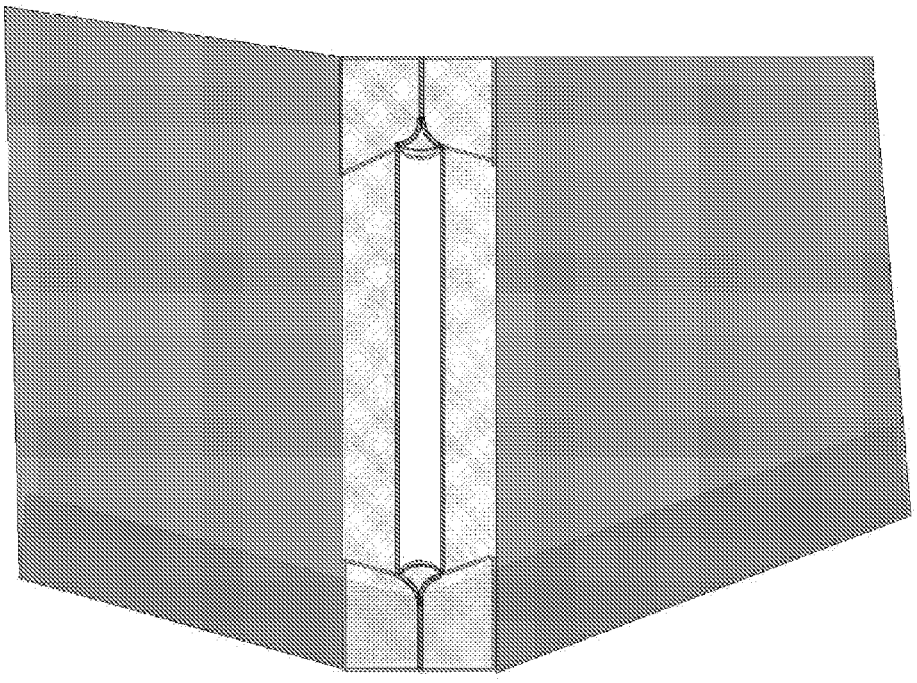
FIG. 8 illustrates an installed embodiment of the invention, and further includes "caps" that can be used at the upper and/or lower ends of the corner to "smooth" the transition around the corner at those areas. Among other things, this facilitates ready use and installation of baseboards, crown-moulding, and other trim in those areas, and generally can provide a more finished appearance to the corner joint of the wall.
Figure 8A:
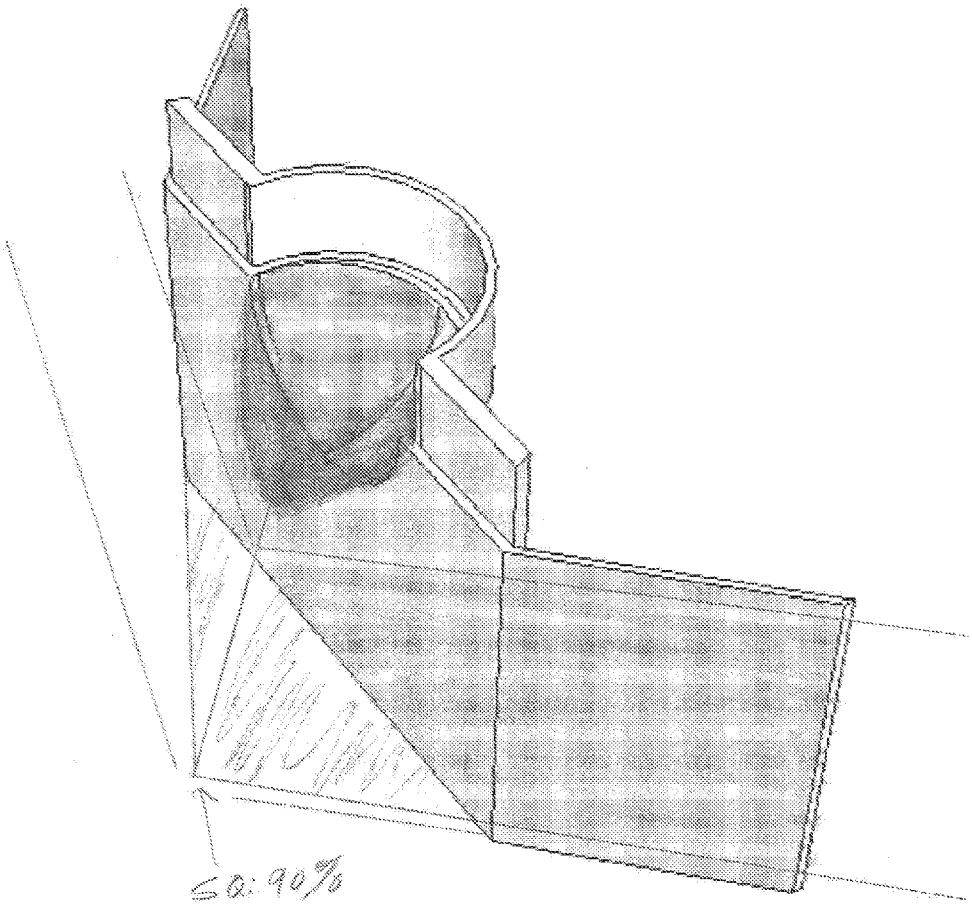
FIG. 8A is related to FIG. 8, but is a perspective view of another embodiment of an upper/lower "cap" element as it may be practiced pursuant to various aspects of the invention.

4. Sanding between coats of mud/wallboard compound will not affect the preferably central elongated web portion of the corneraide of the invention.
5. These and other advantages can be present regardless of the material from which the embodiment is made (e.g., metal, vinyl, paper tape-on, etc.).
6. The invention preferably reduces time and costs compared to other products such as bullnose corneraide. This is especially true for paper tape-on versions, because when the mudded paper area on bullnose is sanded, the paper portion tends to fray, requiring that additional time and mud be used to float out that frayed area with a bullnose tool.
7. The invention preferably provides many texturing options. Among other things, the central web portion can be left smooth, can be textured and then sanded lightly (to create a "knock down" finish/texture), or can be "orange peel textured" by just spraying the central web along with the wall itself and leaving that sprayed condition as the finish.
8. For 3-way corners/joints (see FIGS. 3*a* and 3*b*, for example), an appropriate cap element can be provided to carry the selected pattern toward and/or to the very corner of the assembly (or some or shape can be provided or used within or in the cap area. The invention includes tools that can be conveniently used to finish the cap edges (where they overlap the ends of the "straight" pieces of cornerbead) for this and similar situations.
9. Those finishing tools of the invention can also be used to finish arches or radius walls, such as to finish the contour of the corner bead's central web pattern/portion.

Virtually all of the embodiments of the invention can be adapted into a wide range of applications, and can be used in various combinations or exclusively throughout a building or home. For example, the crown moulding, chair rail, window and door frames, and exterior corners can all incorporate one or more embodiments of the invention. Within a single building or project, the selected cross-section can be the same for ALL of those elements that may be present, or a plurality of cross-sections may be used, intermixed with each other, or otherwise configured to provide a desired result.

For certain applications (for example, inside corners, such as on a windowsill as illustrated above), the ends of the pieces can be angled or otherwise shaped (during production or on the jobsite) to permit 2-way, 3-way, and other corners/joints. Such angles can be provide on one or both ends of a given piece, and multiple angles (such as the "double 45" degree cuts shown in FIG. 6.1) further expand the designs and applications in which the invention can be used. FIGS. 6.2 and 6.3 show some of the many applications of embodiments such as those of FIG. 6.1. FIG. 6.4 shows another of the many angle cuts that may be used (45 degrees), and FIGS. 6.5 and 6.6 show such an embodiment as it might be assembled into a structure.

FIGS. 7.1 through 7.7 provide further illustrations to compare and contrast and demonstrate some of the range of apparatus and methods in which the invention may be utilized. In these illustrations, a "baseline" design is shown in FIGS. 7.1 and 7.2 (with a channel that is approximately 3/16"×1/8"), and the other drawings (7.3-7.7) show how wider/deeper configurations of the invention alternatively can be used on the same or similar sheetrock/framing.

As mentioned above, comparing the various cross-sections in FIGS. 7.1-7.7 helps illustrate the wide range of sizes and applications for the invention, and the flexibility that a given embodiment may have for different specific applications. For example, in a relatively "standard" wallboard corneraide configuration above (½ inch wall board extending only to the edge of the support framing), the dimensions for the illustrated cornerbead can vary depending on designer or customer specifications or other factors.

Among the many alternative applications of the invention, the sheetrock can be different thicknesses, and/or the sheetrock or even the support framing can be "held back" further from the corner. By doing so, larger sizes of channels or other shapes can be utilized at the joint. Examples of such approaches are shown below in FIGS. 7.6 and 7.7 (with channels that are 3/16"×5/16", and 15/16"×15/16", respectively).

Although all of FIGS. 7.1-7.7 have illustrated just one general cross-sectional embodiment of the invention, the same principles preferably apply with respect to other such embodiments. Similarly, the various dimensions discussed herein and for the wings, thicknesses and other aspects of the apparatus can vary beyond those illustrated. The designs can be modified for applications on angles other than 90 degrees, can be positioned asymmetrically/unbalanced, and/or can otherwise be adjusted for custom applications.

Although the examples above focus on some of the many ways that the invention can be installed and enjoyed for interior finishes, it also can be readily sized and adapted for exterior applications (corners, eaves, etc.).

By way of example and not by way of limitation, certain embodiments of the apparatus can be manufactured via processes using one or more steps of injection molding, gluing, bonding, shaping, milling, drilling, injection molding, thermo-forming, casting, and many other existing and new processes that may come into being. Materials are not limited in any way and could extend to include at least certain parts of the apparatus being made from metals to plastics, to resins of all types. A preferred material is lightweight, non-corrosive and will hold up to the exposure anticipated in its eventual usage (including by way of example, chemical reagents, chlorinated water, acidic water, salt water, marine environments, UV exposure, etc.). A preferred method of manufacture is by injection molding and coloring various components of the embodiments, and by machining others and/or buying them from commercially-available sources.

As mentioned above, the designs of the invention can be adapted into crown moulding and similar trim pieces. For certain applications (for example, inside corners, such as on a windowsill), and as shown in some of the drawings, it may be useful to provide a 45 degree angle on one or both ends. FIG. 6.1 below shows such a piece, and FIGS. 6.2 and 6.3 show how two or more such pieces might be assembled together.

FIGS. 7.1 through 7.7 illustrate some of the tremendous variety of applications and resulting "looks" that can be achieved using the invention. In a relatively "standard" wallboard corneraide configuration (½ inch wall board extending only to the edge of the support framing), the dimensions for the illustrated embodiment can vary depending on designer or customer specifications. As shown in Cross-Sections 7.1 and 7.2, the channel is centered, and is approximately 1/8" deep and 3/16" wide.

Without changing the wallboard or support structures, the channel dimensions can vary across a range of width and depth combinations. Cross-Sections 7.3, 7.4, and 7.5 illustrate just a few of those combinations. In Cross-Section 7.3, keeping the channel depth approximately the same as in 1 and 2 (1/8"), the channel width can be up to approximately ½". In Cross-Section 7.4, keeping the channel width approximately the same as in 1 and 2 (⅛"), the channel depth can be up to approximately ¼". In Cross-Section 7.5, the channel width is 5/16", and the channel depth is 3/16").

Among the many alternative applications of the invention, the sheetrock can be different thicknesses, and/or the sheetrock or even the support framing can be "held back" further from the corner. By doing so, larger sizes of channels or other shapes can be utilized at the joint. Examples of such approaches are shown below in Cross-Sections 7.6 and 7.7 (with channels that are 3/16"×5/16", and 15/16"×15/16", respectively).

Although all of Cross-Sections 7.1-7.7 have illustrated an exemplary shape, the same principles apply with respect to other embodiments of the invention. Similarly, the various dimensions discussed herein and for the wings, thicknesses and other aspects of the designs can vary beyond those illustrated. The designs can be modified for applications on angles other than 90 degrees, can be positioned asymmetrically/unbalanced, and/or can otherwise be adjusted for custom applications.

In addition to the sample applications discussed herein, many others exist, including corneraide-type pieces (such as discussed herein) being built into or added onto the following items:

Kerf metal corners for doorway trim
other window/doorway trim
stucco corner bead
chair rail
crown moulding
niches
pop-outs
roof tile (caps or field tile)
acoustical tile grid (t-bar)
countertop edges
French doors (inserts or windows)
special floor tiles (with interlocking corners and inserts to fit the selected design)
decorative ceilings (tray ceilings, stepped dropdowns, panels, crown molds or coves)
electrical can lights
cement masonry unit block (ends or faces)
cultured stone veneer (corners or faces)
automotive tire rims
chrome moldings on cars
bicycle or motor cycle frames
patio covers that serve as shade covers (e.g., sticks of cornerbead product of the invention spaced from each other, such as at 1" or 2" apart)
vinyl fence (tops and or faces)

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because it is being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

For the purpose of summarizing the invention, certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

The apparatus and methods of the invention have been described with some particularity, but the specific designs, constructions, and steps disclosed are not to be taken as delimiting of the invention. A wide range of modifications and alternative structures and steps for practicing the invention will make themselves apparent to those of ordinary skill in the art, all of which will not depart from the essence of the invention, and all such changes and modifications are intended to be encompassed within the appended claims.

Although the examples of the many various methods of the invention are described herein with steps occurring in a certain order, the specific order of the steps, or any continuation or interruption between steps, is not necessarily intended to be required for any given method of practicing the invention.

What is claimed is:

1. A construction between two walls that generally form a corner, including:

a first generally planar surface generally parallel to a first of the two walls and extending in a confronting relationship with said first of the two walls, and a second generally planar surface generally parallel to a second of the two walls and extending in a confronting relationship with said second of the two walls, said first and second generally planar surfaces extending substantially the full length of the corner, a third generally flat planar surface positioned and extending generally between said first and second generally planar surfaces for substantially the full length of the corner, said third surface including generally centrally between said first and second generally planar surfaces a non-flat indentation extending at least substantially the length of the construction, said indentation shaped in cross section to include at least one portion generally parallel to the first of the two walls and at least another portion generally parallel to the second of the two walls.

2. A method of finishing a corner between two or more non-aligned walls, including the steps of providing a cornerbead of claim 1, and installing it in an operative position adjacent the corner.

3. The construction of claim 1, in which the walls are a wall and an adjacent ceiling, and the construction is sized and configured as crown moulding.

4. Chair rail configured in cross-section as the construction in claim 1.

5. The construction of claim 1, in which the walls are two abutting walls, and the construction is sized and configured as cornerbead.

6. The construction of claim 1, in which the walls are exterior surfaces of buildings.

7. The construction of claim 1, including in a generally central position of its cross section a W shape.

8. The construction of claim 7, in which said W shape is elongated to at least generally correspond in length with said third generally flat planar surface.

* * * * *